US005657632A

United States Patent [19]

Foss

[11] Patent Number: 5,657,632

[45] Date of Patent: Aug. 19, 1997

[54] DUAL FUEL GAS TURBINE COMBUSTOR

[75] Inventor: David T. Foss, Winter Park, Fla.

[73] Assignee: Westinghouse Electric Corporation, Pittsburgh, Pa.

[21] Appl. No.: 336,892

[22] Filed: Nov. 10, 1994

[51] Int. Cl.[6] ..... F02C 3/20; F02G 3/00

[52] U.S. Cl. ..... 60/742; 60/39.463; 60/733; 60/737; 239/416.4; 239/549

[58] Field of Search ..... 60/39.463, 733, 60/737, 742, 747; 239/417.3, 416.5, 416.4, 423, 424.5, 447, 549

[56] References Cited

U.S. PATENT DOCUMENTS

| | | | |
|---|---|---|---|
| 5,351,477 | 10/1994 | Joshi et al. | 60/39.463 |
| 5,359,847 | 11/1994 | Pillsbury et al. | 60/39.463 |
| 5,408,825 | 4/1995 | Foss et al. | 60/737 |

FOREIGN PATENT DOCUMENTS

| | | |
|---|---|---|
| 0594127 | 4/1994 | European Pat. Off. . |
| 0627596 | 12/1994 | European Pat. Off. . |
| 0670456 | 9/1995 | European Pat. Off. . |
| 2284885 | 6/1996 | United Kingdom . |
| WO95/20131 | 7/1995 | WIPO . |

OTHER PUBLICATIONS

Willis, et al., "Industrial RB211 Dry Low Emission Combustion", CT Engineers, 1993, 1–7 published by the Amer. Soc. Mechanical Engineers.

Willis, et al., "Low Emissions Combustors Design Options for An Aero Derived Industrial Gas Turbine", published by Canadian Gas Assoc., 1991, 1–25.

*Primary Examiner*—Charles G. Freay

[57] ABSTRACT

A combustor for a gas turbine having primary and secondary combustion zones. The combustor has a centrally disposed dual fuel nozzle that can supply a fuel rich mixture of either liquid or gaseous fuel to the primary combustion zone. The combustor also has primary gas fuel spray pegs for supplying a lean mixture of gaseous fuel to the primary combustion zone via a first annular pre-mixing passage and secondary dual fuel spray bars for supplying a lean mixture of either gaseous or liquid fuel to the secondary combustion zone via a second annular pre-mixing passage. The dual fuel spray bars are aerodynamically shaped and have passages for distributing gas and liquid fuel to a number of fuel discharge ports. The gas fuel discharge ports are formed in two rows on either side of the spray bar. The liquid fuel discharge ports are formed by a row of spray nozzles arranged along the downstream edge of the spray bar.

20 Claims, 5 Drawing Sheets

DUAL FUEL GAS TURBINE COMBUSTOR

BACKGROUND OF THE INVENTION

The present invention relates to a gas turbine combustor for burning both liquid and gaseous fuel in compressed air. More specifically, the present invention relates to a low NOx combustor having the capability of burning lean mixtures of both liquid and gaseous fuel.

In a gas turbine, fuel is burned in compressed air, produced by a compressor, in one or more combustors. Traditionally, such combustors had a primary combustion zone in which an approximately stoichiometric mixture of fuel and air was formed and burned in a diffusion type combustion process. Fuel was introduced into the primary combustion zone by means of a centrally disposed fuel nozzle. When operating on liquid fuel, such nozzles were capable of spraying fuel into the combustion air so that the fuel was atomized before it entered the primary combustion zone. Additional air was introduced into the combustor downstream of the primary combustion zone so that the overall fuel/air ratio was considerably less than stoichiometric—i.e., lean. Nevertheless, despite the use of lean fuel/air ratios, the fuel/air mixture was readily ignited at start-up and good flame stability was achieved over a wide range of firing temperatures due to the locally richer nature of the fuel/air mixture in the primary combustion zone.

Unfortunately, use of rich fuel/air mixtures in the primary combustion zone resulted in very high temperatures. Such high temperatures promoted the formation of oxides of nitrogen ("NOx"), considered an atmospheric pollutant. It is known that combustion at lean fuel/air ratios reduces NOx formation. However, achieving such lean mixtures requires that the fuel be widely distributed and very well mixed into the combustion air. This can be accomplished by pre-mixing the fuel into the combustion air prior to its introduction into the combustion zone.

In the case of gaseous fuel, this pre-mixing can be accomplished by introducing the fuel into primary and secondary annular passages that pre-mix the fuel and air and then direct the pre-mixed fuel into primary and secondary combustion zones, respectively. The gaseous fuel is introduced into these primary and secondary pre-mixing passages using fuel spray tubes distributed around the circumference of each passage. A combustor of this type is disclosed in "Industrial RB211 Dry Low Emission Combustion" by J. Willis et al., American Society of Mechanical Engineers (May 1993).

Unfortunately, such combustors are capable of operation on only gaseous fuel because the fuel spray tubes are not adapted to atomize liquid fuel into the combustor. Liquid fuel spray nozzles, such as those used in conventional rich-burning combustors, are known. However, using spray nozzles to introduce liquid fuel into the pre-mixing passage without the use of bulky or complex structure that unnecessarily disrupts the flow of air through the passage presents a problem in that the liquid fuel must be well dispersed around the circumference of the passage in order to avoid locally fuel-rich zones that would result in increased NOx generation.

It is therefore desirable to provide a lean burning gas turbine combustor capable of introducing liquid fuel into a pre-mixing passage in a simple and aerodynamically suitable manner.

SUMMARY OF THE INVENTION

Accordingly, it is the general object of the current invention to provide a lean burning gas turbine combustor capable of introducing liquid fuel into a pre-mixing passage in a simple and aerodynamically suitable manner.

Briefly, this object, as well as other objects of the current invention, is accomplished in a gas turbine comprising a compressor section for producing compressed air and a combustor for heating the compressed air. The combustor has a combustion zone and fuel pre-mixing means for pre-mixing gaseous and liquid fuel into at least a first portion of the compressed air so as to form a fuel/air mixture and for subsequently introducing the fuel/air mixture into the combustion zone. The fuel pre-mixing means includes an annular passage formed between first and second concentrically arranged cylindrical liners that is in flow communication with the compressor section and the combustion zone, whereby the first portion of the compressed air flows through the annular passage. The fuel pre-mixing means also includes a plurality of members projecting into the annular passage, each of which has means for introducing the gaseous fuel into the first portion of the compressed air and means for introducing the liquid fuel into the first portion of the compressed air.

According to one embodiment of the invention, the members are dispersed around the circumference of the annular passage and each has a plurality of gaseous fuel discharge ports and a plurality of liquid fuel spray nozzles. The liquid fuel spray nozzles are distributed along trailing edges of the members and the gaseous fuel discharge ports are distributed along opposing sides of the members.

DESCRIPTION OF THE PREFERRED EMBODIMENT

Figure 1:
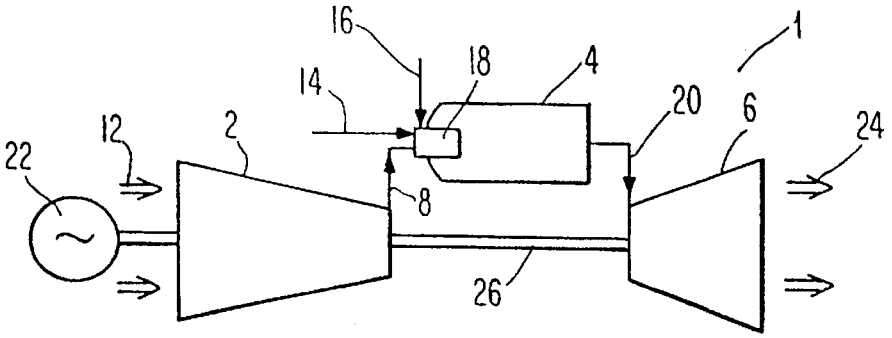
FIG. 1 is a schematic diagram of a gas turbine employing the combustor of the current invention.

Referring to the drawings, there is shown in FIG. 1 a schematic diagram of a gas turbine 1. The gas turbine 1 is comprised of a compressor 2 that is driven by a turbine 6 via a shaft 26. Ambient air 12 is drawn into the compressor 2 and compressed. The compressed air 8 produced by the compressor 2 is directed to a combustion system that includes one or more combustors 4 and a fuel nozzle 18 that introduces both gaseous fuel 16 and oil fuel 14 into the combustor. As is conventional, the gaseous fuel 16 may be natural gas and the liquid fuel 14 may be no. 2 diesel oil, although other gaseous or liquid fuels could also be utilized. In the combustors 4, the fuel is burned in the compressed air 8, thereby producing a hot compressed gas 20.

The hot compressed gas 20 produced by the combustor 4 is directed to the turbine 6 where it is expanded, thereby producing shaft horsepower for driving the compressor 2, as well as a load, such as an electric generator 22. The expanded gas 24 produced by the turbine 6 is exhausted, either directly to the atmosphere or, in a combined cycle plant, to a heat recovery steam generator and then to atmosphere.

Figure 2:
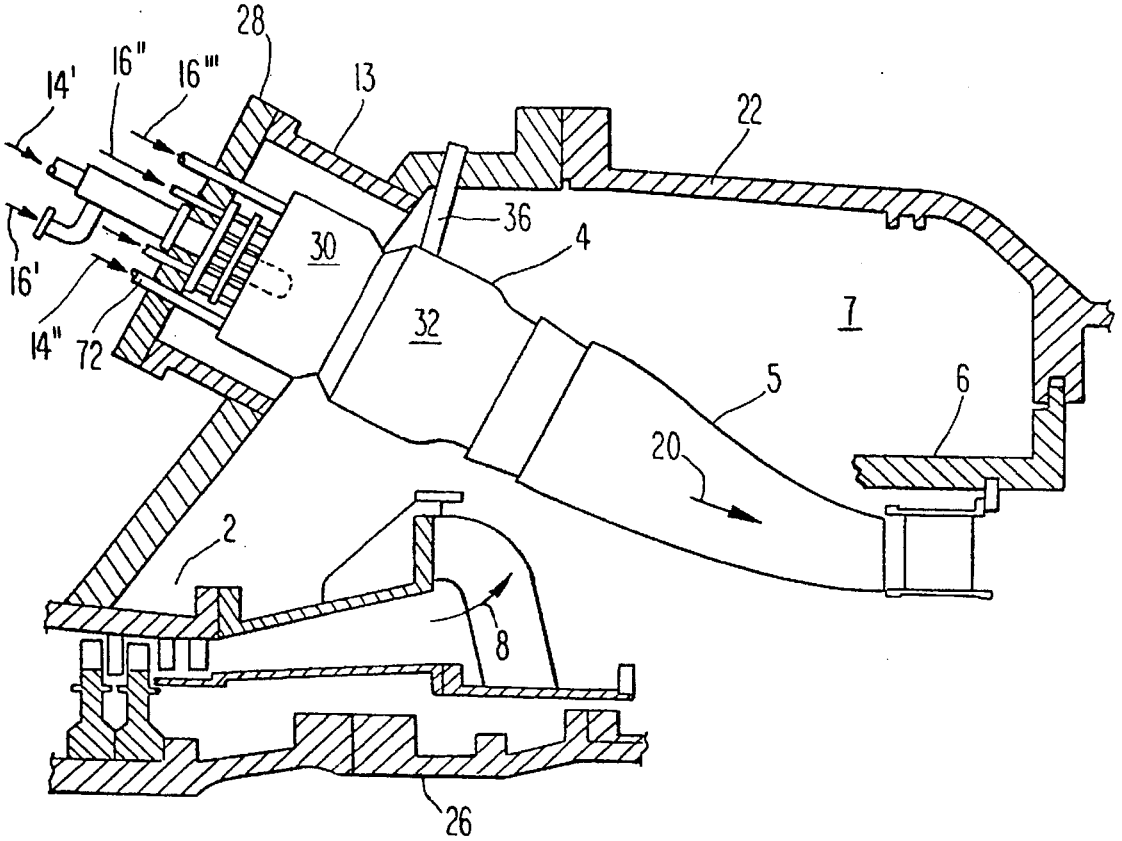
FIG. 2 is a longitudinal cross-section through the combustion section of the gas turbine shown in FIG. 1.

FIG. 2 shows the combustion section of the gas turbine 1. A circumferential array of combustors 4, only one of which is shown, are connected by cross-flame tubes 82, shown in FIG. 3, and disposed in a chamber 7 formed by a shell 22. Each combustor has a primary section 30 and a secondary section 32. The hot gas 20 exiting from the secondary section 32 is directed by a duct 5 to the turbine section 6. The primary section 30 of the combustor 4 is supported by a support plate 28. The support plate 28 is attached to a cylinder 13 that extends from the shell 22 and encloses the primary section 30. The secondary section 32 is supported by eight arms (not shown) extending from the support plate 28. Separately supporting the primary and secondary sections 30 and 32, respectively, reduces thermal stresses due to differential thermal expansion.

Figure 3:
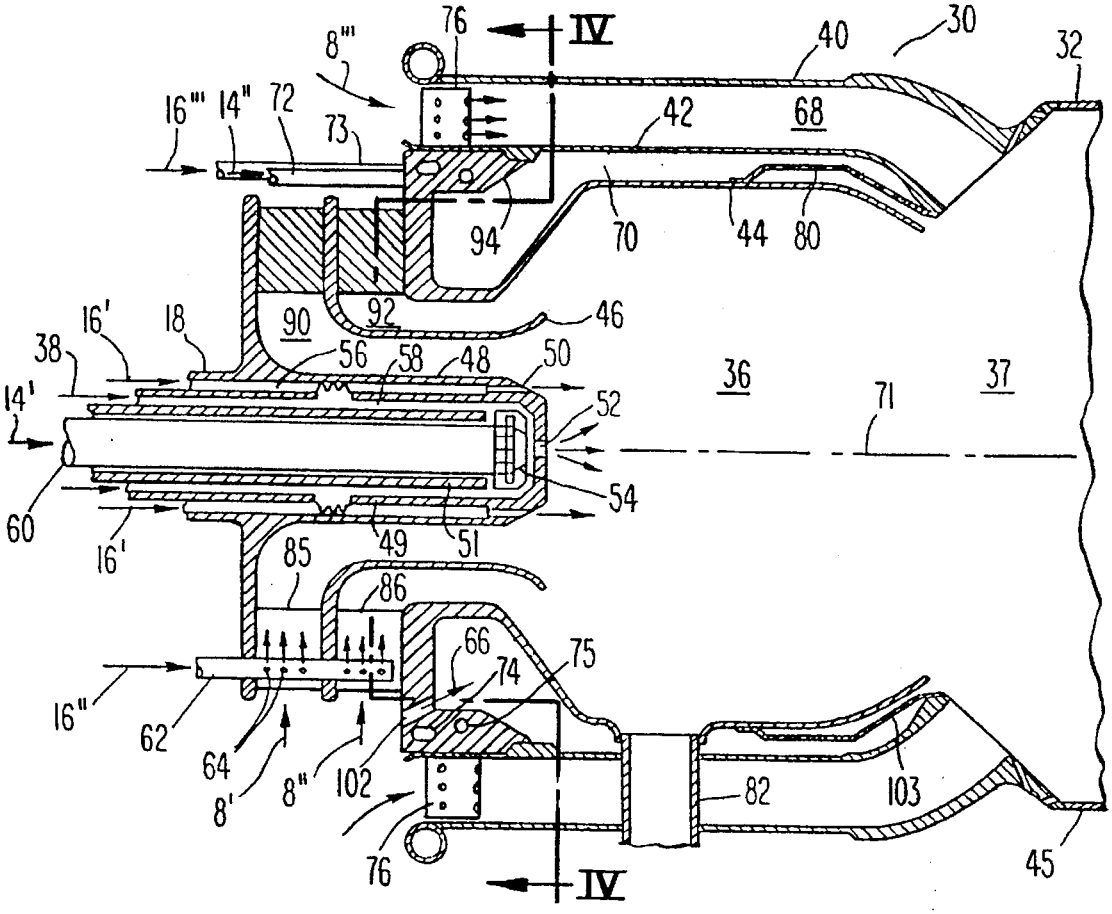
FIG. 3 is a longitudinal cross-section through the combustor shown in FIG. 2, with the cross-section taken through lines III—III shown in FIG. 4.

The combustor 4 has a combustion zone having primary and secondary portions. Referring to FIG. 3, the primary combustion zone portion 36 of the combustion zone, in which a lean mixture of fuel and air is burned, is located within the primary section 30 of the combustor 4. Specifically, the primary combustion zone 36 is enclosed by a cylindrical inner liner 44 portion of the primary section 30. The inner liner 44 is encircled by a cylindrical middle liner 42 that is, in turn, encircled by a cylindrical outer liner 40. The liners 40, 42 and 44 are concentrically arranged around an axial center line 71 so that an inner annular passage 70 is formed between the inner and middle liners 44 and 42, respectively, and an outer annular passage 68 is formed between the middle and outer liners 42 and 44, respectively.

An annular ring 94, in which gas and liquid fuel manifolds 74 and 75, respectively, are formed, is attached to the upstream end of liner 42. The annular ring is disposed within the passage 70—that is, between the fuel pre-mixing passages 92 and 68—so that the presence of the manifolds 74 and 75 does not disturb the flow of air 8" and 8'" into either of the pre-mixing passages 92 and 68. Cross-flame tubes 82, one of which is shown in FIG. 3, extend through the liners 40, 42 and 44 and connect the primary combustion zones 36 of adjacent combustors 4 to facilitate ignition.

Since the inner liner 44 is exposed to the hot gas in the primary combustion zone 36, it is important that it be cooled. This is accomplished by forming a number of holes 102 in the radially extending portion of the inner liner 44, as shown in FIG. 3. The holes 102 allow a portion 66 of the compressed air 8 from the compressor section 2 to enter the annular passage 70 formed between the inner liner 44 and the middle liner 42. An approximately cylindrical baffle 103 is located at the outlet of the passage 70 and extends between the inner liner 44 and the middle liner 42. A number of holes (not shown) are distributed around the circumference of the baffle 103 and divide the cooling air 66 into a number of jets that impinge on the outer surface of the inner liner 44, thereby cooling it. The air 66 then discharges into the secondary combustion zone 37.

As shown in FIG. 3, according to the current invention, a dual fuel nozzle 18 is centrally disposed within the primary section 30. The fuel nozzle 18 is comprised of a cylindrical outer sleeve 48, which forms an outer annular passage 56 with a cylindrical middle sleeve 49, and a cylindrical inner sleeve 51, which forms an inner annular passage 58 with the middle sleeve 49. An oil fuel supply tube 60 is disposed within the inner sleeve 51 and supplies oil fuel 14' to an oil fuel spray nozzle 54. The oil fuel 14' from the spray nozzle 54 enters the primary combustion zone 36 via an oil fuel discharge port 52 formed in the outer sleeve 48. Gas fuel 16' flows through the outer annular passage 56 and is discharged into the primary combustion zone 36 via a plurality of gas fuel ports 50 formed in the outer sleeve 48. In addition, cooling air 38 flows through the inner annular passage 58.

Figure 4:
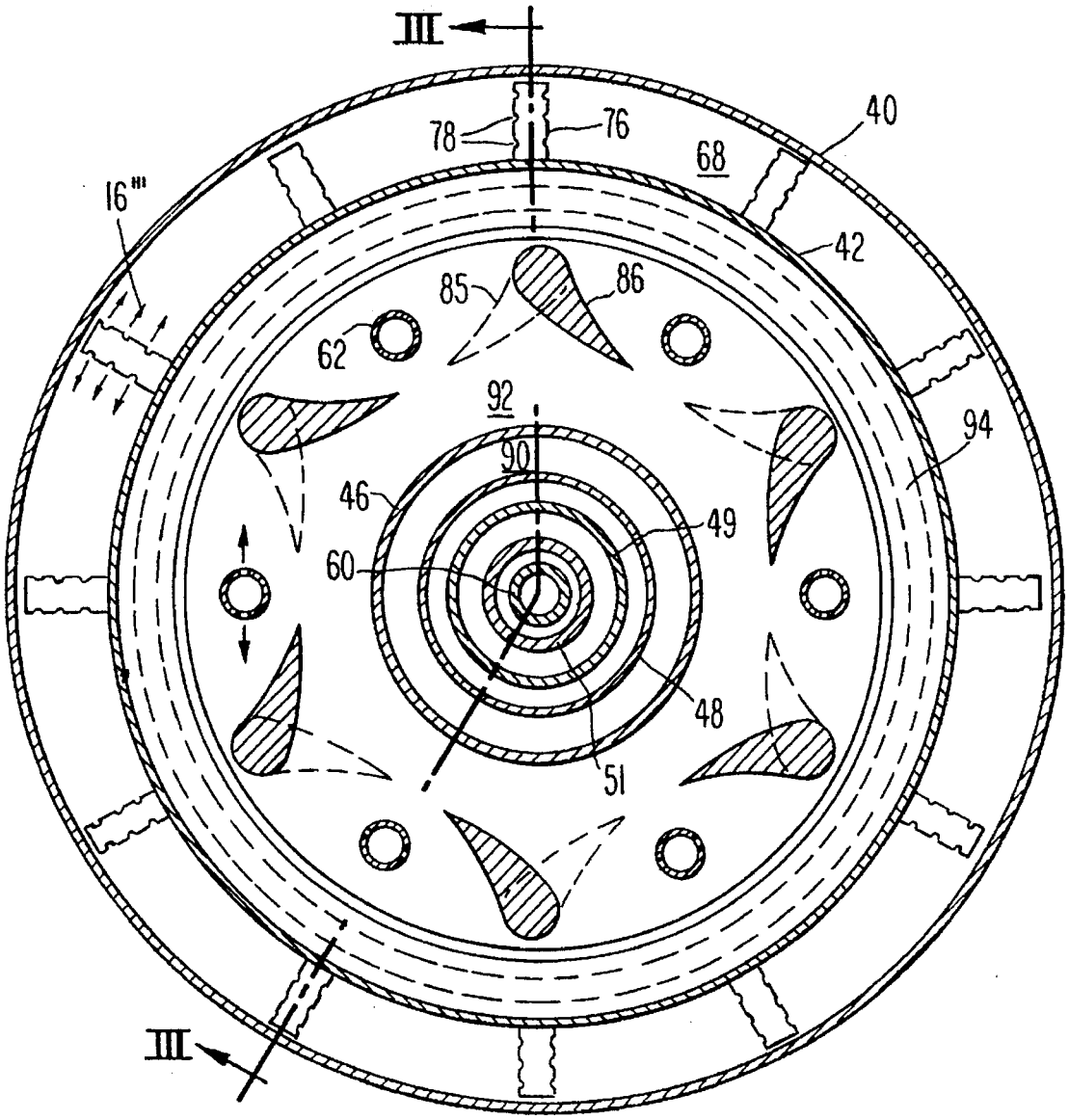
FIG. 4 is a transverse cross-section taken through lines IV—IV shown in FIG. 3.

Pre-mixing of gaseous fuel 16" and compressed air from the compressor 2 is accomplished for the primary combustion zone 36 by primary pre-mixing passages 90 and 92, which divide the incoming air into two streams 8' and 8". As shown in FIGS. 3 and 4, a number of axially oriented, tubular primary fuel spray pegs 62 are distributed around the circumference of the primary pre-mixing passages 90 and 92. Two rows of gas fuel discharge ports 64, one of which is shown in FIG. 3, are distributed along the length of each of the primary fuel pegs 62 so as to direct gas fuel 16" into the air steams 8' and 8" flowing through the passages 90 and 92. The gas fuel discharge ports 64 are oriented so as to discharge the gas fuel 16" circumferentially in the clockwise and counterclockwise directions—that is, perpendicular to the direction of the flow of air 8' and 8".

As also shown in FIGS. 3 and 4, a number of swirl vanes 85 and 86 are distributed around the circumference of the upstream portions of the passages 90 and 92. In the preferred embodiment, a swirl vane is disposed between each of the primary fuel pegs 62. As shown in FIG. 4, the swirl vanes 85 impart a counterclockwise (when viewed: against the direction of the axial flow) rotation to the air stream 8', while the swirl vanes 86 impart a clockwise rotation to the air stream 8". The swirl imparted by the vanes 85 and 86 to the air streams 8' and 8" helps ensure good mixing between the gas fuel 16" and the air, thereby eliminating locally fuel rich mixtures and the associated high temperatures that increase NOx generation.

As shown in FIG. 3, the secondary combustion zone portion 37 of the combustion zone is formed within a liner 45 in the secondary section 32 of the combustor 2. The outer annular passage 68 discharges into the secondary combustion zone 37 and, according to the current invention, forms both a liquid and gaseous fuel pre-mixing passage for the secondary combustion zone. The passage 68 defines a center line that is coincident with the axial center line 71. A portion 8'" of the compressed air 8 from the compressor section 2 flows into the passage 68.

As shown in FIGS. 3 and 4, a number of radially oriented secondary dual fuel spray bars 76 are circumferentially distributed around the secondary pre-mixing passage 68 and serve to introduce gas fuel 16'" and liquid fuel 14" into the compressed air 8'" flowing through the passage. This fuel mixes with the compressed air 8'" and is then delivered, in a well mixed form without local fuel-rich zones, to the secondary combustion zone 37.

Each of the dual fuel spray bars 76 is a radially oriented, aerodynamically shaped, elongate member that projects into the pre-mixing passage 68 from the liner 42, to which it is attached. As shown best in FIG. 6, each of the spray bars 76 has an approximately rectangular shape with substantially straight sides connected by rounded leading and trailing edges 100 and 101, respectively. This aerodynamically desirable shape minimizes the disturbance to the flow of air 8'" through the passage 68. As discussed further below, both gas and liquid fuel passages 95 and 96, respectively, are formed in each spray bar 76. The passages 95 and 96 are axially aligned one behind the other so as to minimize the cross-sectional area of the spray bar.

Figure 5:
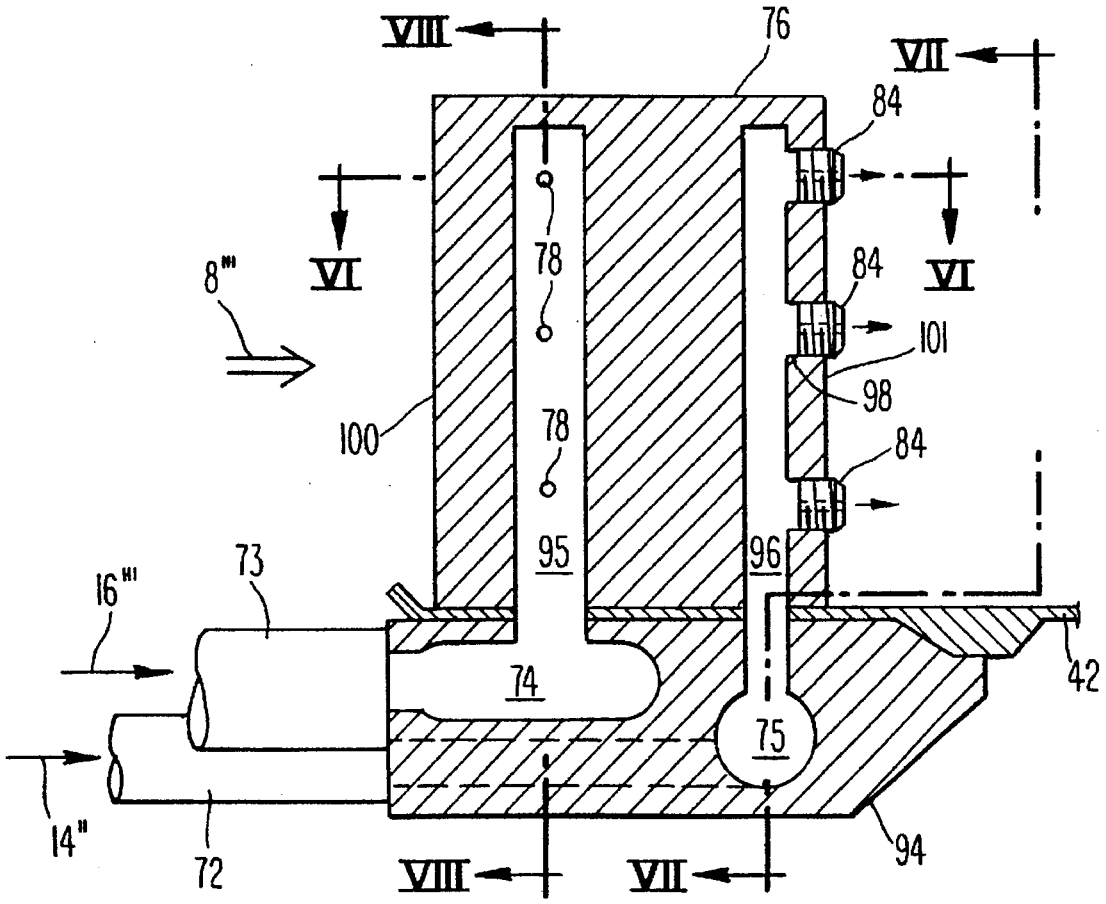
FIG. 5 is a detailed view of a cross-section of the dual fuel spray bar shown in FIGS. 3 and 4.
Figure 6:
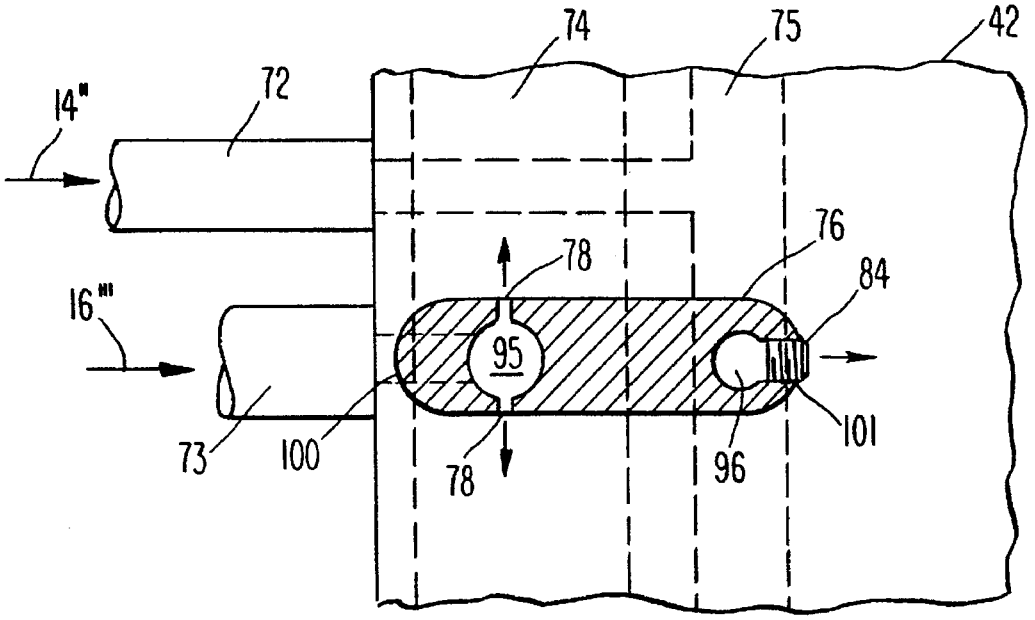
FIG. 6 is a cross-section taken through line VI—VI shown in FIG. 5.
Figure 8:
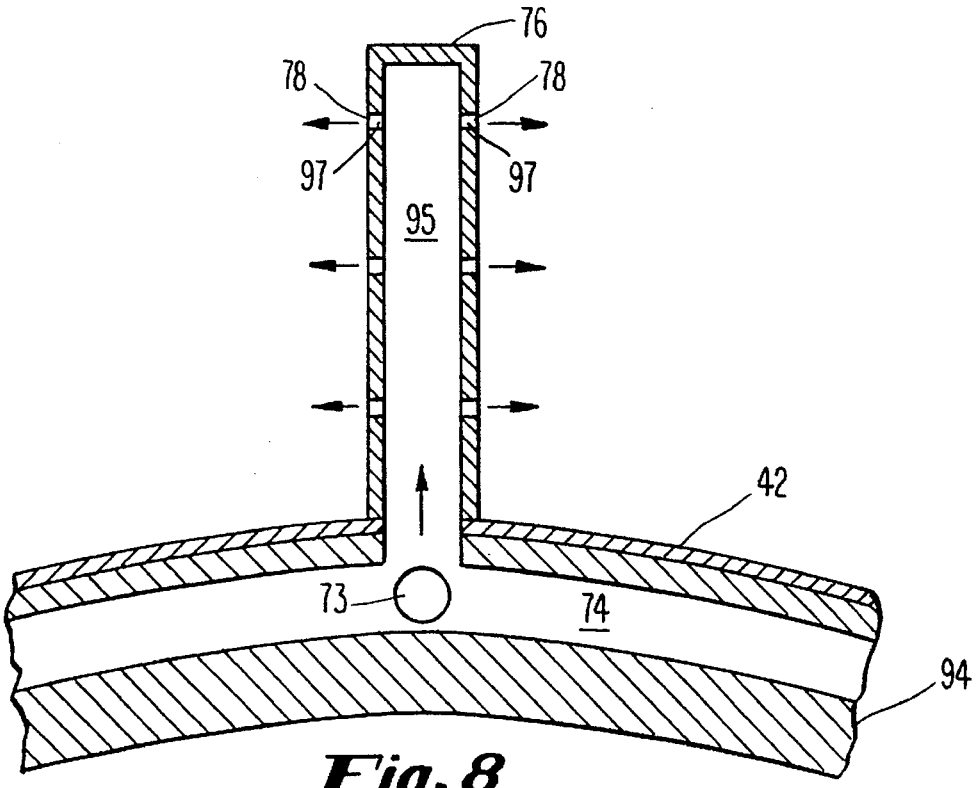
FIG. 8 is a cross-section taken through line VIII—VIII shown in FIG. 5.

Gas fuel 16''' is supplied to the dual fuel spray bars 76 by a circumferentially extending gas fuel manifold 74 formed within the ring 94, as shown in FIGS. 5, 6 and 8. Several axially extending gas fuel supply tubes 73 are distributed around the manifold 74 and serve to direct the gas fuel 16''' to it. Passages 95 extend radially from the gas manifold 74 through each of the spray bars 76. Two rows of small gas fuel passages 97, each of which extends from the radial passage 95, are distributed over the length of each of the spray bars 76 along opposing sides of the spray bars, as shown in FIG. 8. The radial passage 95 serves to distributes gas fuel 16''' to each of the small passages 97. The small passages 97 form discharge ports 78 on the sides of the spray bar 76 that direct gas fuel 16''' into the air 8''' flowing through the secondary pre-mixing passage 68. As shown best in FIGS. 6 and 8, the gas fuel discharge ports 78 are oriented so as to discharge the gas fuel 16''' circumferentially in both the clockwise and counterclockwise directions—that is perpendicular to the direction of the flow of air 8'''.

Figure 7:
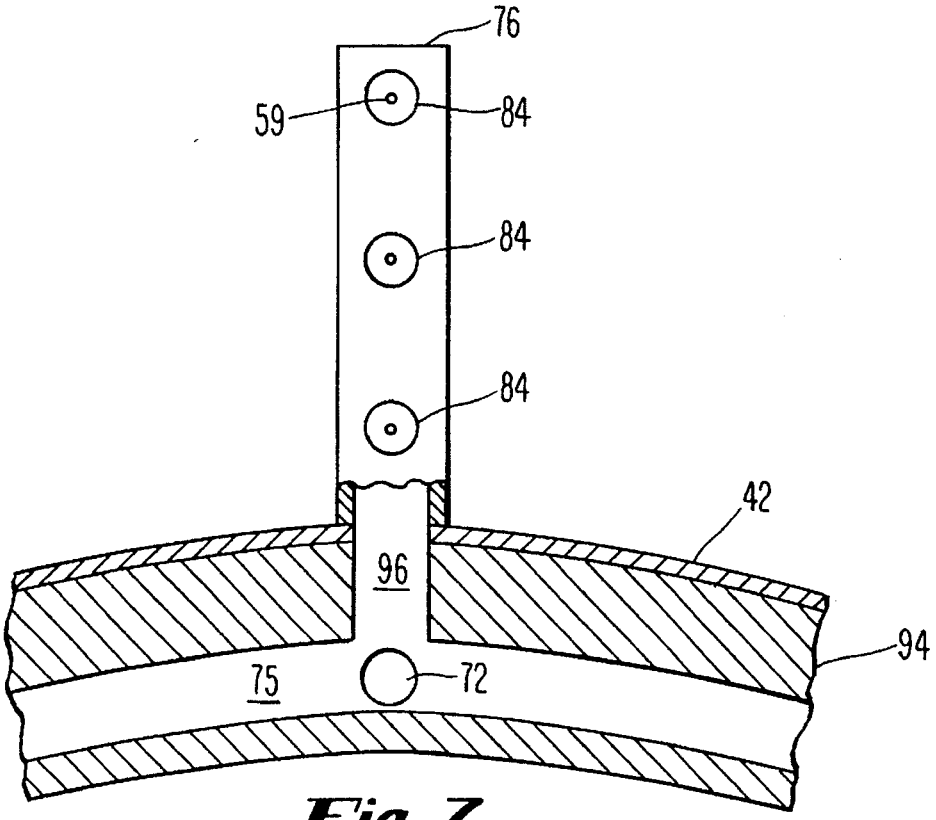
FIG. 7 is a cross-section taken through line VII—VII shown in FIG. 5.

According to the current invention, the dual fuel spray bars 76 also serve to introduce liquid fuel 14" into the secondary pre-mixing passage 68 in order to pre-mix the liquid fuel 14" and the compressed air 8'''. Liquid fuel 14" is supplied to the dual fuel spray bars 76 by a circumferentially extending liquid fuel manifold 75 formed within the ring 94, as shown in FIGS. 5, 6 and 7. Several axially extending oil fuel supply tubes 72 are distributed around the manifold 75 and serve to direct the liquid fuel 14" to it. Passages 96 extend radially from the liquid fuel manifold 75 through each of the spray bars 76. As shown in FIG. 6, each liquid passage 96 is located directly downstream of the gas fuel passage 95.

A row of liquid fuel passages 98, each of which extends axially from the radial passage 96, are distributed along the length of each of the spray bars 76 at its trailing edge 101. The radial passage 96 serves to distribute the liquid fuel 14" to each of the axial passages 98. A fuel spray nozzle 84 is located at the end of each passage 98, for example by screw threads. Each spray nozzle 84 has an orifice 59, shown in FIG. 7, that causes it to discharge an atomized spray of liquid fuel 14". Suitable spray nozzles 84 are available from Parker-Hannifin of Andover, Ohio, and are available with orifices that create either flat or conical spray patterns. As shown in FIG. 6, the spray nozzles 84 are oriented so as to direct the liquid fuel 14" in the axially downstream direction—that is, in the direction of the flow of air 8'''.

Since the fuel spray nozzles 84 are distributed both radially and circumferentially around the second pre-mixing passage 68, local fuel-rich zones are avoided. Moreover, according to the current invention, this is accomplished without disrupting the flow of air 8''' through the passage 68.

During gas fuel operation, a flame is initially established in the primary combustion zone 36 by the introduction of gas fuel 16' via the central fuel nozzle 18. As increasing load on the turbine 6 requires higher firing temperatures, additional fuel is added by introducing gas fuel 16" via the primary fuel pegs 62. Since the primary fuel pegs 62 result in a much better distribution of the fuel within the air, they produce a leaner fuel/air mixture than the central nozzle 18 and hence lower NOx. Thus, once ignition is established in the primary combustion zone 36, the fuel to the central nozzle 18 can be shut-off. Further demand for fuel flow beyond that supplied by the primary fuel pegs 62 can then be satisfied by supplying additional fuel 16''' via the secondary fuel spray bars 76.

During liquid fuel operation, a flame is initially established in the primary combustion zone 36 by the introduction of liquid fuel 14' via the central fuel nozzle 18, as in the case of gaseous fuel operation. Additional fuel is added by introducing liquid fuel 14" into the secondary combustion zone 37 via the secondary pre-mixing passage 68. Since the use of the distributed fuel spray bars 76 results in a much better distribution of the fuel within the air than does the central nozzle 18, the combustion of the liquid fuel 14" introduced through the secondary pre-mixing passage 68 produces a leaner fuel/air mixture and hence lower NOx than the combustion of the fuel 14' through the central nozzle 18. Thus, once ignition is established in the primary combustion zone 36, the fuel 14' to the central nozzle 18 need not be increased further since the demand for additional fuel flow can be satisfied by supplying fuel 14" to the spray bars 76.

The present invention may be embodied in other specific forms without departing from the spirit or essential attributes thereof and, accordingly, reference should be made to the appended claims, rather than to the foregoing specification, as indicating the scope of the invention.

I claim:

1. A gas turbine comprising:

a) a compressor section for producing compressed air;

b) a combustor having a primary combustion zone for heating at least a partial flow of said compressed air;

c) a secondary combustion zone, said primary combustion zone being in flow communication with said secondary combustion zone; and d) fuel pre-mixing means for pre-mixing gaseous and liquid fuel into at least a first portion of said compressed air so as to form a fuel/air mixture and for subsequently introducing said fuel/air mixture into said secondary combustion zone, said fuel pre-mixing means including (A) an annular passage formed between first and second concentrically arranged cylindrical liners, said annular passage in flow communication with said compressor section and said secondary combustion zone, whereby said first portion of said compressed air flows through said annular passage, and (B) a plurality of members projecting into said annular passage, each of said members having means for introducing said gaseous fuel into said first portion of said compressed air and means for introducing said liquid fuel into said first portion of said compressed air.

2. The gas turbine according to claim 1, wherein said members are dispersed around the circumference of said annular passage.

3. The gas turbine according to claim 1, wherein each of said members has a plurality of gaseous fuel discharge ports and a plurality of liquid fuel spray nozzles.

4. The gas turbine according to claim 3, wherein each of said members has leading and trailing edges, and wherein said liquid fuel spray nozzles are distributed along said trailing edges of said members.

5. The gas turbine according to claim 4, wherein each of said members has opposing sides extending between said leading and trailing edges and facing substantially perpendicular to the direction of flow of said first portion of said compressed air through said annular passage, and wherein said gaseous fuel discharge ports are distributed along each of said opposing sides of said members.

6. The gas turbine according to claim 3, wherein said member has a length, and wherein said gas fuel discharge ports and said liquid fuel spray nozzles are each distributed along said length of said member.

7. The gas turbine according to claim 3, wherein each of said members has means for distributing said gaseous fuel to each of said gaseous fuel discharge ports.

8. The gas turbine according to claim 7, wherein said gaseous fuel distributing means comprises a gaseous fuel passage formed within said member.

9. The gas turbine according to claim 8, wherein each of said members has means for distributing said liquid fuel to each of Said liquid fuel spray nozzles.

10. The gas turbine according to claim 9, wherein said liquid fuel distributing means comprises a liquid fuel passage formed within each of said members.

11. The gas turbine according to claim 10, wherein said combustor further comprises:

a) a circumferentially extending gaseous fuel manifold in flow communication with each of said gaseous fuel passages in said members; and b) a circumferentially extending liquid fuel manifold in flow communication with each of said liquid fuel passages in said members.

12. The gas turbine according to claim 1, wherein each of said members projects radially into said annular passage.

13. A combustor for heating compressed air in a gas turbine, comprising:

a) a first liner enclosing primary and secondary combustion zones;

b) a first annular passage in flow communication with said primary combustion zone, said first annular passage having an inlet for receiving a first flow of compressed air;

c) first fuel introducing means for introducing a gaseous fuel into said first annular passage;

d) a second annular passage in flow communication with said secondary combustion zone, said second annular passage having an inlet for receiving a second flow of compressed air; and e) a plurality of elongate bodies, each having a length in the radial direction and extending radially into said second annular passage for introducing both gaseous and liquid fuel into said second annular passage, wherein each of said elongate bodies has a plurality of gaseous fuel discharge ports and a plurality of liquid fuel spray nozzles being distributed along said length.

14. The combustor according to claim 4, wherein:

a) each of said elongate bodes has a leading and trailing edge, each of said liquid fuel spray nozzles being distributed along said trailing edges; and b) each of said members has opposing sides extending between said leading and trailing edges, said gaseous fuel discharge ports being distributed along each of said opposing sides.

15. The combustor according to claim 4, wherein each of said elongate bodies has first and second radially extending passages formed therein, said first passage in flow communication with each of said gaseous fuel discharge ports, said second passage in flow communication with each of said liquid fuel spray nozzles.

16. The combustor according to claim 15, wherein each of said first radially extending passages is axially aligned with one of said second radially extending passages.

17. The combustor according to claim 15, further comprising first and second circumferentially extending manifolds in flow communication with each of said first and second passages, respectively, in said elongate bodies.

18. A gas turbine comprising:

a) a compressor section for producing compressed air;

b) a combustor for heating said compressed air, said combustor having:

(i) a combustion zone, and (ii) fuel pre-mixing means for pre-mixing a fuel into at least a first portion of said compressed air so as to form a fuel/air mixture and for subsequently introducing said fuel/air mixture into said combustion zone, said fuel pre-mixing means including (A) an annular passage formed between first and second concentrically arranged cylindrical liners, said annular passage in flow communication with said compressor section and said combustion zone, whereby said first portion of said compressed air flows through said annular passage, and (B) a plurality of members having leading and trailing edges and projecting into said annular passage, each of said members having a plurality of gaseous fuel discharge ports for introducing a gaseous fuel into said first portion of compressed air and a plurality of liquid fuel spray nozzles distributed along said trailing edges for introducing a liquid fuel into said first portion of said compressed air.

19. The gas turbine according to claim 18, wherein each of said members has opposing sides extending between said leading and trailing edges and facing substantially perpendicular to the direction of flow of said first portion of said compressed air through said annular passage, and wherein said gaseous fuel discharge ports are distributed along each of said opposing sides of said members.

20. The gas turbine according to claim 19, wherein said combustor further comprises:

a) a circumferentially extending gaseous fuel manifold in flow communication with each of said members; and b) a circumferentially extending liquid fuel manifold in flow communication with each said members.

* * * * *